United States Patent [19]

Cali

[11] 4,115,669

[45] Sep. 19, 1978

[54] RETRACTABLE BREAKER SWITCH TOGGLE HANDLE

[76] Inventor: Frank J. Cali, P.O. Box 279, Patterson, La. 70392

[21] Appl. No.: 800,512

[22] Filed: May 25, 1977

[51] Int. Cl.[2] ..... H01H 3/04

[52] U.S. Cl. ..... 200/331; 200/335; 16/115

[58] Field of Search ..... 200/331, 330, 335, 332, 200/322, 338; 293/34; 16/115, 110 R

[56] References Cited

U.S. PATENT DOCUMENTS

| | | | |
|---|---|---|---|
| 1,797,466 | 3/1931 | Dehuff | 200/330 |
| 2,010,492 | 8/1935 | Karre | 16/110 R |
| 2,382,738 | 8/1945 | Moyses | 200/330 |
| 2,580,905 | 1/1952 | Foster | 200/331 |
| 2,719,898 | 10/1955 | Allen | 200/331 |
| 2,723,329 | 11/1955 | Baird | 16/115 |
| 2,726,303 | 12/1955 | Berndsen | 200/331 |
| 3,121,778 | 2/1964 | Sander et al. | 200/331 |
| 3,142,744 | 7/1964 | Keck | 200/331 |
| 3,159,048 | 12/1964 | Clifford | 200/331 |
| 3,581,037 | 5/1971 | Schiffelbein | 200/331 |

*Primary Examiner*—William Price
*Assistant Examiner*—Joseph Man-Fu Moy
*Attorney, Agent, or Firm*—Clarence A. O'Brien; Harvey B. Jacobson

[57] ABSTRACT

A short sleeve is provided for telescoping over a switch toggle and an elongated lever arm has one end thereof pivotally attached to one end of the sleeve for angular displacement relative thereto about an axis extending transversely of the sleeve and the lever arm. The sleeve and lever arm include coacting structure operative to releasably retain the lever arm in predetermined angular position relative to the sleeve with the arm defining an endwise outward extension of the aforementioned one end of the sleeve, the other end of the sleeve being open for telescoping over an associated switch toggle.

7 Claims, 6 Drawing Figures

RETRACTABLE BREAKER SWITCH TOGGLE HANDLE

BACKGROUND OF THE INVENTION

Various forms of switch toggle actuating levers or arms have been heretofore provided. However, most of these switch toggle actuating arms are especially constructed for use in conjunction with specific forms of switch toggles. In addition, previously known switch toggle arms or handles require especially constructed switch toggles for attachment of the handles thereto. Accordingly, a need exists for a switch toggle handle which may be utilized in conjunction with various forms of standard switch toggles and which may be readily removably secured to many different forms of standard switch toggles.

Examples of previously known switch toggle handles or operators are disclosed in U.S. Pat. Nos. 1,797,466, 1,850,771, 2,723,329, 1,159,048 and 3,617,676.

SUMMARY OF THE INVENTION

The switch toggle handle of the instant invention has been designed for use in conjunction with conventional switch toggles and further in a manner whereby the free end of the handle may be retracted inwardly relative to a surface outwardly from which the associated switch toggle projects. In addition, the toggle handle is constructed in a manner whereby it may be readily removably attached to various forms of switch toggles.

The main object of this invention is to provide a switch toggle handle which may be utilized on various forms of switch toggles.

Another object of this invention is to provide a switch toggle handle constructed in a manner whereby it may be semipermanently attached to an associated switch toggle.

Still another object of this invention is to provide a switch toggle handle whose outer free end may be retracted inwardly relative to the surface outwardly of which the associated switch toggle projects.

Still another important object of this invention is to provide a switch toggle handle of a construction lending itself to being manufactured from various materials.

A final object of this invention to be specifically enumerated herein is to provide a switch toggle handle in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 2:
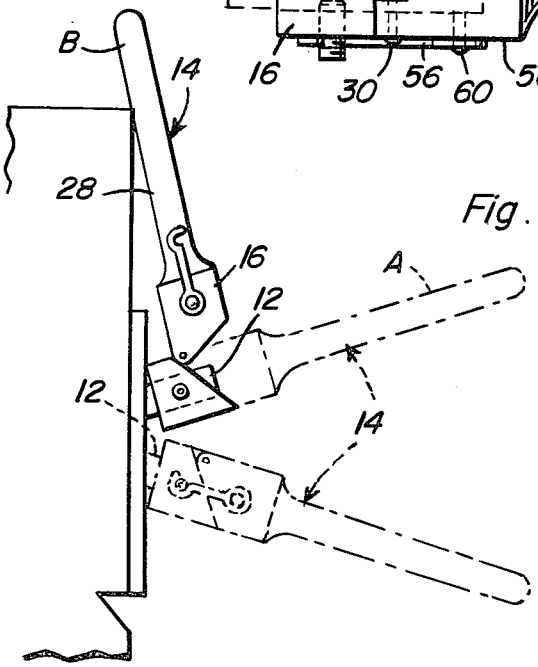
FIG. 2 is a side, elevational view of the assemblage illustrated in FIG. 1 and with the switch toggle and handle illustrated in alternate positions.

Referring now more specifically to the drawings, the numeral 10 generally designates a circuit breaker assembly including an actuating breaker toggle 12 which may be swung between open and closed positions, such as the open position illustrated in solid lines in FIG. 2 and the closed position illustrated in phantom lines in FIG. 2.

The toggle handle of the instant invention is referred to in general by the reference numeral 14 and includes a sleeve 16 defining a longitudinal passage 18 extending therethrough. One end of the sleeve 16 is squared and the other end thereof is beveled as at 20 toward the upper side 22 of the sleeve 16.

The beveled end 20 of the sleeve 16 includes upper side mounting ears 24 received between pairs of similar mounting ears 26 formed on one end of an elongated handle 28 and a pivot fastener 30 extends through the mounting ears 24 and 26 and thus pivotally attaches the handle 28 to the sleeve 16. The end of the handle 28 opposing the beveled end 20 of the sleeve 16 is beveled as at 32 whereby the opposing faces of the adjacent ends of the sleeve 16 and handle 28 are disposed in closely juxtaposed position when the handle 28 forms an endwise outward extension of the sleeve 16.

Figure 6:
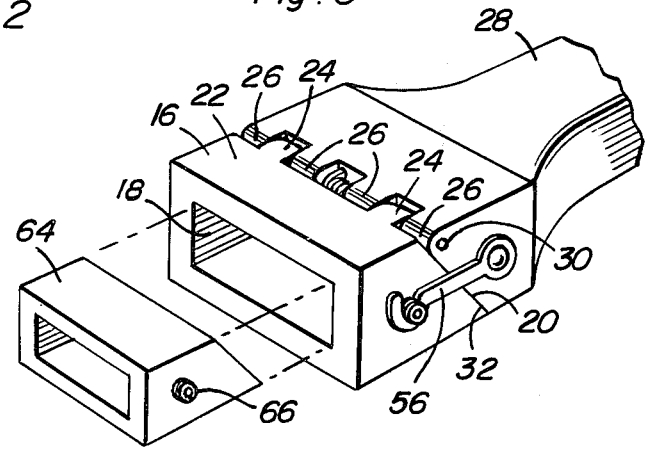

A butterfly spring 34 is encircled about a midportion of the pivot fastener 30 and yieldingly biases the handle 28 from the position A thereof illustrated in FIG. 2 to the position B thereof illustrated in FIG. 2. The opposite side walls 36 and 38 of the sleeve 16 have threaded bores 40 and 42 formed therethrough and set screws 44 and 46 are threadedly engaged through the bores 40 and 42 and may be tightened against opposite sides of the toggle 12 in order to semi-permanently mount the sleeve 16 on the toggle 12. In addition, the opposite sides 48 and 50 of the handle 28 corresponding to the sides 36 and 38 of the sleeve 16 have hooks 54 and 56 pivotally secured thereto by means of pivot fasteners 58 and 60 and the hooks 54 and 56 are engageable with the set screws 44 and 46 in order to secure the handle 28 in the position thereof relative to the sleeve 16 illustrated in FIG. 6 and against swinging movement of the handle 28 from the A position of FIG. 2 to the B position of FIG. 2.

The end of the handle 28 pivotally attached to the sleeve 16 includes a recess 62 formed therein opening toward and forming an extension of the adjacent end of the passage 18. Further, an adapter sleeve 64 is provided and is similar to but smaller than the sleeve 16. The adapter sleeve 64 includes opposite side set screws 66 corresponding to the set screws 44 and 46 and which may be utilized to removably secure the adapter sleeve 64 on a smaller breaker toggle. Thereafter, after the adapter sleeve 64 has been secured to a smaller breaker toggle, the sleeve 16 may be telescoped over the adapter sleeve 64 and secured thereto by tightening of the set screws 44 and 46 into engagement with the outer ends of the set screws 66.

Figure 1:
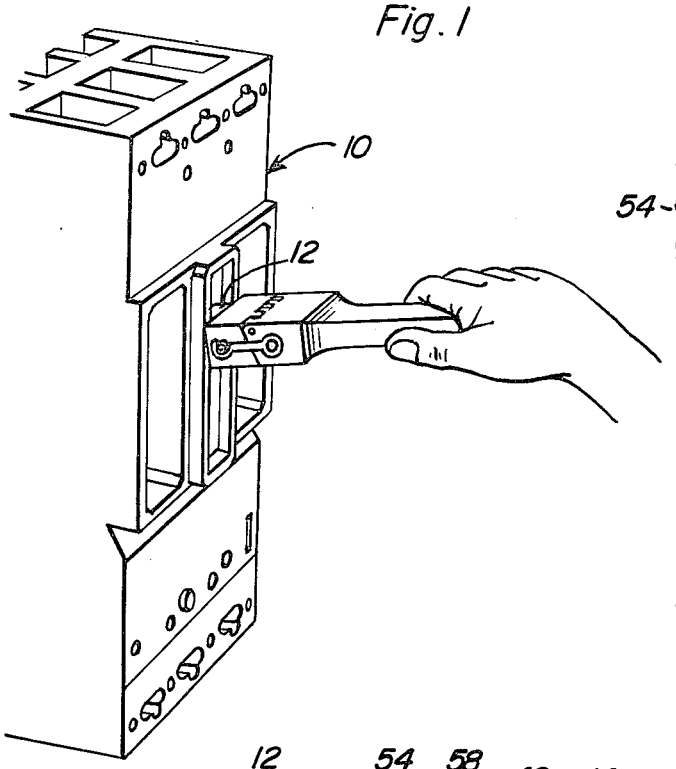
FIG. 1 is a fragmentary, perspective view of a switch box having a breaker switch toggle projecting outwardly therefrom and the handle of the instant invention operatively associated with the switch toggle.
Figure 4:
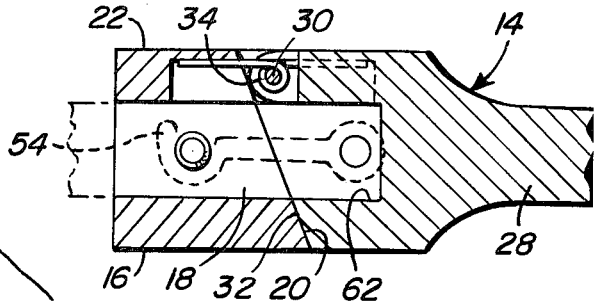
FIG. 4 is a fragmentary, vertical, sectional view taken substantially upon the plane indicated by the section line 4—4 of FIG. 3.
Figure 5:
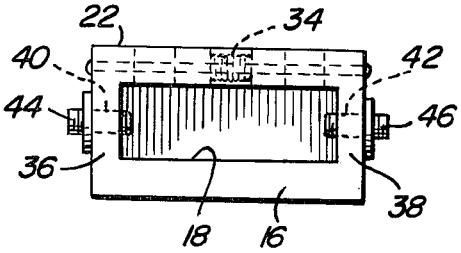
FIG. 5 is an end elevational view of the base end of the toggle handle; and, FIG. 6 is a fragment, perspective view of the base end of the toggle handle illustrating a sleeve insert which may be utilized in conjunction with the handle in order to adapt it for use in conjunction with switch toggles of smaller dimensions.
Figure 3:
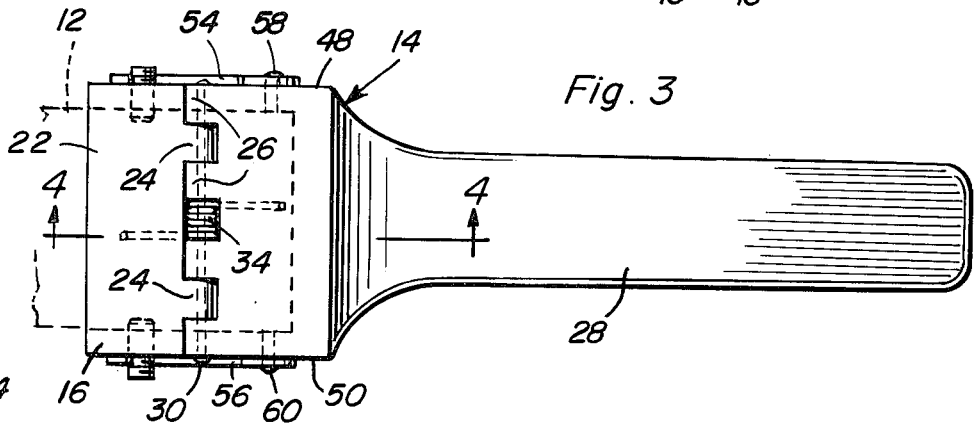
FIG. 3 is a top plan view of the toggle handle on somewhat of an enlarged scale.

In operation, the handle 14 is mounted on the toggle 12 in a manner which is believed to be obvious from the foregoing. The hooks 54 and 56 may be utilized to secure the handle 28 in the position thereof illustrated in FIG. 1 and indicated as at A in FIG. 2. In this position, the handle 28 may be utilized to swing the toggle 28 to the off position thereof illustrated in phantom lines in FIG. 2. Of course, with the handle 28 locked in position against angular displacement relative to the sleeve 16 by means of the hooks 54 and 56, the handle 28 may also be utilized to swing the toggle 12 from the phantom line position thereof illustrated in FIG. 2 to the solid line position of FIG. 2 wherein the toggle is in the "on" position. Thereafter, if clearance outwardly of the breaker assembly 10 is desired, the hooks 54 and 56 are released and the handle 28 is swung, by the biasing action of spring 34, upwardly to the over center solid line position thereof illustrated in FIG. 2 designated by B. This pivotal movement of the handle 28 to a retracted position is of great benefit when the breaker assembly 10 is mounted in a narrow passageway.

The handle 12 may be readily constructed of various materials. For instance, the sleeve 16 and handle 28 as well as the adapter sleeve 64 may be constructed of plastic. In addition, these components may also be constructed of inexpensive metal, such as aluminum.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A switch toggle operator comprising a sleeve member and a handle member, said sleeve member including first and second sections, and each section comprising first and second ends, a top portion and a bottom portion, said first end of said first section including means for telescoping over a switch toggle and said first end of said second section being integral with said handle member, said sections being joined together by a pivot means at an axis extending transversely of said sleeve member for relative angular displacement, each of said second ends including an oppositely beveled face extending from said top portion to said bottom section, said pivot means being disposed at one of said top portions and adjacent said beveled faces are closely juxtaposed when said sections are in end to end aligned position, said sleeve member including means to releasably retain said sections in said end to end aligned position.

2. The combination of claim 1 including spring means operatively connected between said first section and said second section yieldingly biasing said second section in one direction of angular displacement relative to said first section away from said end to end aligned position.

3. The combination of claim 2 wherein said spring means acts upon said second section upwardly from said end to end aligned position.

4. The combination of claim 1 wherein said first section is generally rectangular in internal cross section.

5. The combination of claim 1 wherein when said retain means being released, said second section being swingable upwardly to an over center gravity position.

6. The combination of claim 1 wherein said first section includes exteriorally operable set screw means projecting laterally inwardly of the interior thereof for engagement with a switch toggle over which said first section is telescoped.

7. The combination of claim 1 including an adapter sleeve removably telescopingly received and secured in the first section.

* * * * *